US006532601B1

(12) United States Patent
Berman

(10) Patent No.: US 6,532,601 B1
(45) Date of Patent: Mar. 18, 2003

(54) HEADGEAR WITH MANIPULATABLE PROJECTIONS

(76) Inventor: Robert Berman, 1028 Rowland Ave., Glendora, NJ (US) 08029

( * ) Notice: Subject to any disclaimer, the term of this patent is extended or adjusted under 35 U.S.C. 154(b) by 9 days.

(21) Appl. No.: 09/974,231

(22) Filed: Oct. 10, 2001

(51) Int. Cl.[7] ..... A42B 1/06; A42B 1/24
(52) U.S. Cl. ..... 2/410; 2/171; 2/209.13
(58) Field of Search ..... 2/171, 410, 209.13, 2/422, 244; 446/27; 362/106

(56) References Cited

U.S. PATENT DOCUMENTS

| | | | | |
|---|---|---|---|---|
| 1,776,175 A | | 9/1930 | Wittekind | |
| 3,098,316 A | | 7/1963 | McCarthy | 46/43 |
| 3,106,184 A | | 10/1963 | Shea | 116/114 |
| 3,216,725 A | * | 11/1965 | Hing | 446/27 |
| 3,254,444 A | * | 6/1966 | Paterson | 2/209.13 |
| 3,705,466 A | * | 12/1972 | Sela | 446/27 |
| 4,447,250 A | | 5/1984 | Wolens et al. | 46/1 |
| 4,601,070 A | | 7/1986 | Sargentini | 2/209 |
| D289,942 S | | 5/1987 | Wolens | D2/251 |
| 4,665,568 A | | 5/1987 | Stutes | 2/209 |
| D306,882 S | | 3/1990 | Yeh | D21/59 |
| 5,088,127 A | | 2/1992 | Thornock | 2/199 |
| 5,297,443 A | * | 3/1994 | Wentz | 446/27 |
| 5,323,492 A | | 6/1994 | DeMars | 2/209.13 |
| 5,395,278 A | | 3/1995 | Dickhut | 446/486 |
| 5,530,970 A | | 7/1996 | Knutson | 2/209.13 |
| 6,256,796 B1 | | 7/2001 | Fleming | 2/209.13 |
| 6,356,773 B1 | * | 3/2002 | Rinot | 2/171 |

* cited by examiner

*Primary Examiner*—Rodney M. Lindsey
(74) *Attorney, Agent, or Firm*—Synnestvedt & Lechner LLP

(57) ABSTRACT

Headgear having a plurality of projections extending outwardly therefrom is disclosed. The projections have compliant portions located between each end and are manually manipulatable by bending, twisting and curving into various configurations. The projections are thermoplastic tubes having sidewalls formed of frusto-conically shaped annuli joined in an accordion pleated fashion. The annuli have two stable positions relative to each other, either adjacent in contact or angularly displaced. The two stable positions permit the projections to maintain a particular shape until manually rearranged. Complementary couplings on the free end of the projections allow the tube to be joined to form continuous loops.

20 Claims, 3 Drawing Sheets

HEADGEAR WITH MANIPULATABLE PROJECTIONS

FIELD OF THE INVENTION

The invention concerns headgear, particularly hats and helmets, having manipulatable projections for amusement and promotional endeavors.

BACKGROUND OF THE INVENTION

Headgear, including hats, caps, helmets, headbands and the like, provide a natural vehicle for striking decorative displays having aesthetic or amusing characteristics. By virtue of its position atop the head of a person, unusual or flamboyant headgear will draw attention to the wearer and, thus, provide simple gratification or enable the person to draw the viewer's attention, once captured by the headgear, to a more serious message, for example, for promotional ends such as advertising.

SUMMARY OF THE INVENTION

The invention concerns headgear, preferably in the form of a hat, cap or helmet, for wearing on a head of a person. The headgear comprises a structure adapted for support upon the head and an elongated projection having a first end attached to the structure and a free end extending outwardly away therefrom. The projection has a flexible, compliant portion arranged between the ends allowing the projection to be manually manipulatable into a desired shape. The flexible, compliant portion maintains the desired shape until it is manually manipulated into another desired shape.

Preferably, the flexible, compliant portion extends substantially over the entire length of the projection. Preferably, the flexible, compliant portion of each projection comprises a tube having a sidewall comprising a plurality of annuli arranged coaxially face to face adjacent one another. Each annulus has an inner circumference attached to an inner circumference of an adjacent annulus and an outer circumference attached to an outer circumference of another adjacent annulus so as to form, lengthwise along the tube, a series of peaks and valleys defined by the outer circumferences and the inner circumferences respectively. Each annulus has a frusto-conical shape and a width different from an adjacent annulus such that an annulus having a relatively greater width is positioned adjacent to an annulus having a relatively smaller width. The width is defined as the difference between the outer and inner diameters of an annulus. Each annulus is stabily positionable in a first position in contact with an adjacent annulus and a second position angularly displaced away from an adjacent annulus, the first and second positions allowing the tube to be bent, curved, expanded and compressed in a desired configuration and maintain the configuration due to the stability of the first and the second positions of the annuli.

Preferably, the headgear has a plurality of the projections, each projection having a first end attached either the crown or the brim of the headgear. In a preferred embodiment, the free end of one of the projections has a coupling mounted thereon, and the free end of another of the projections has a complementary coupling mounted thereon. The complementary coupling is adapted to engage the coupling on the one projection and thereby form a substantially continuous loop projecting outwardly from the helmet.

DETAILED DESCRIPTION OF A PREFERRED EMBODIMENT

Figure 1:
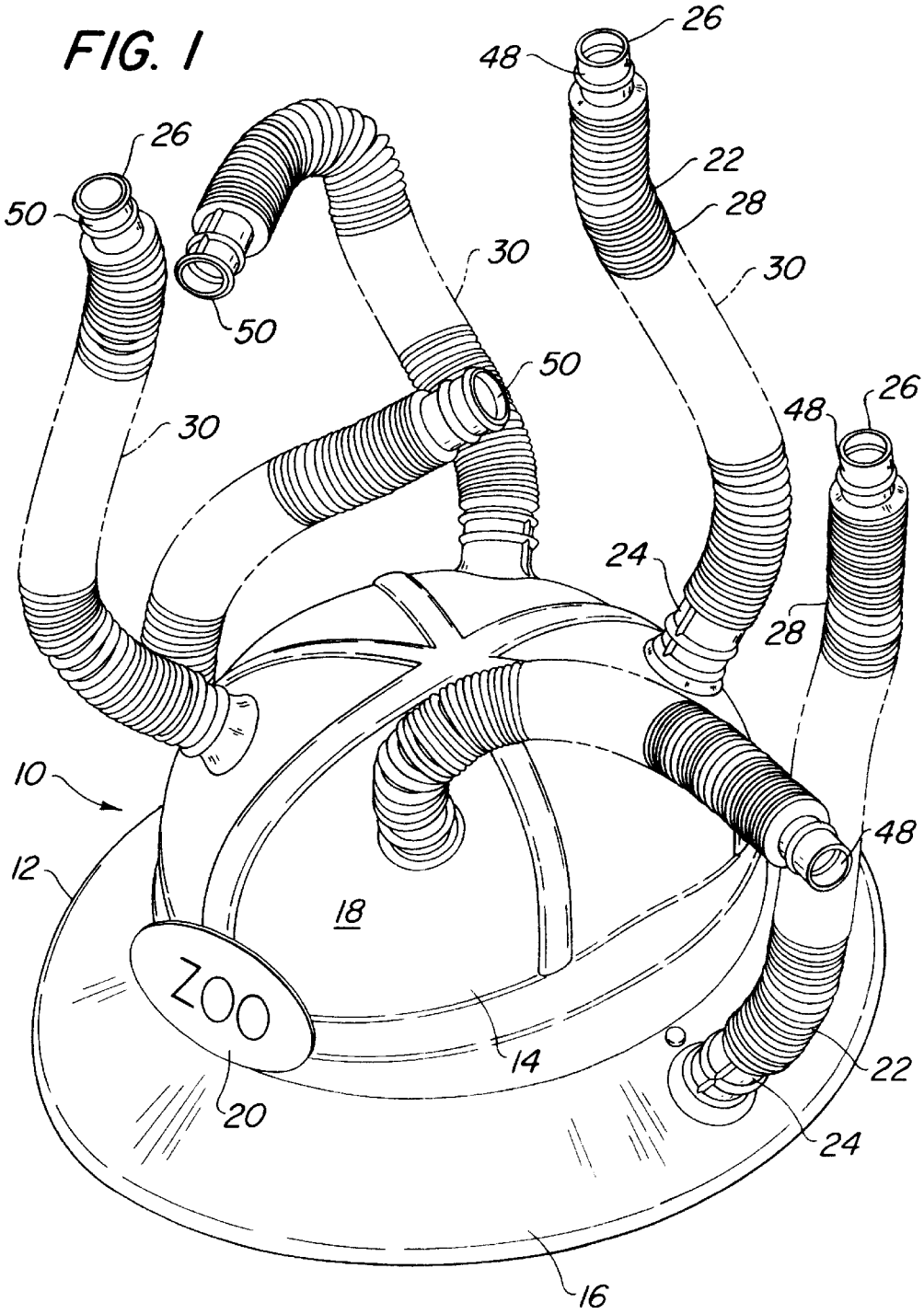
FIG. 1 is a perspective view of a helmet having manipulatable projections according to the invention.

FIG. 1 shows headgear 10 comprising a structure 12 adapted to accommodate the head of a wearer. Structure 12 preferably comprises a curved crown 14 defining an interior space sized to receive the head of the wearer, and a brim 16 extending peripherally around the crown to act as a shade in the traditional manner of a hat or cap. Preferably both crown and brim are integrally molded from a durable, lightweight plastic material and form a protective helmet, although structure 12 is by no means limited to such a configuration or such materials. The outer surface 18 of the structure 12 provides a region for the display of promotional messages 20.

The headgear includes a plurality of elongated projections 22, each having a first end 24 attached to outer surface 18. As shown in FIG. 1, projections 22 are preferably attached to both the crown 14 and brim 16 and extend outwardly to position their free ends 26 away from the surface 18. Other embodiments may provide for attachment of the projections at only the crown or, alternatively, only the brim. In addition, for headgear comprising structures for support upon the head other than or in addition to a crown and a brim, projections may be attached to such other structures in accordance with the present invention.

Figure 2:
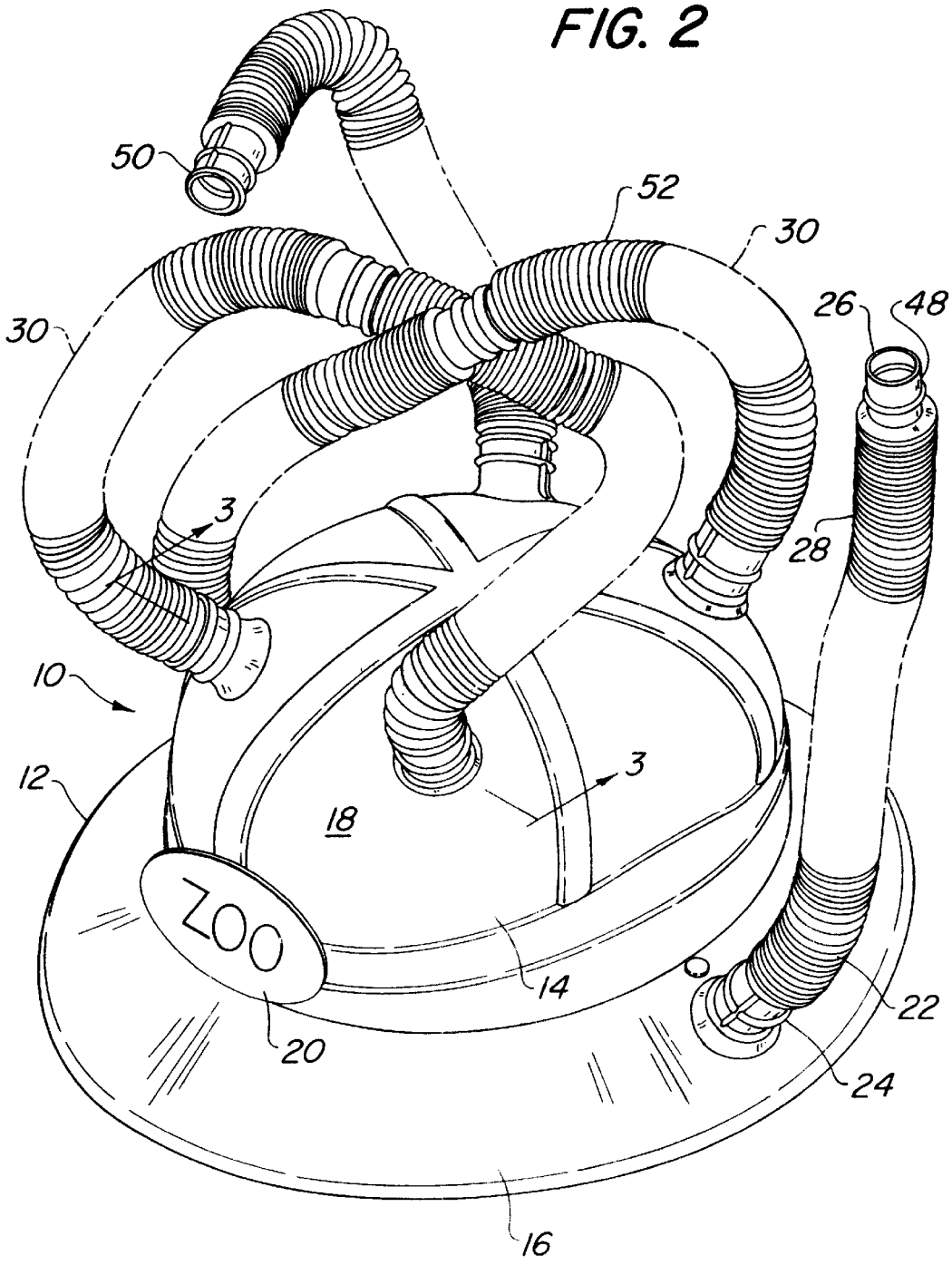
FIG. 2 is a perspective view of the helmet shown in FIG. 1 wherein the projections are shown in a manipulated configuration.

Each projection 22 has a flexible, compliant portion 28 arranged between the ends 24 and 26. The flexible, compliant portion allows the projections 22 to be manually manipulated into various different shapes and configurations as shown in FIGS. 1 and 2 to present an amusing, artistic or unusual display, which is temporary in nature. Due to the flexible, compliant portion 28, the projections 22 will hold the desired shape into which it is formed until such time and the wearer desires that the headgear have a different appearance. The projections may then be manually manipulated into a different desired shape, the projections holding the shape until again reconfigured.

Figure 3:
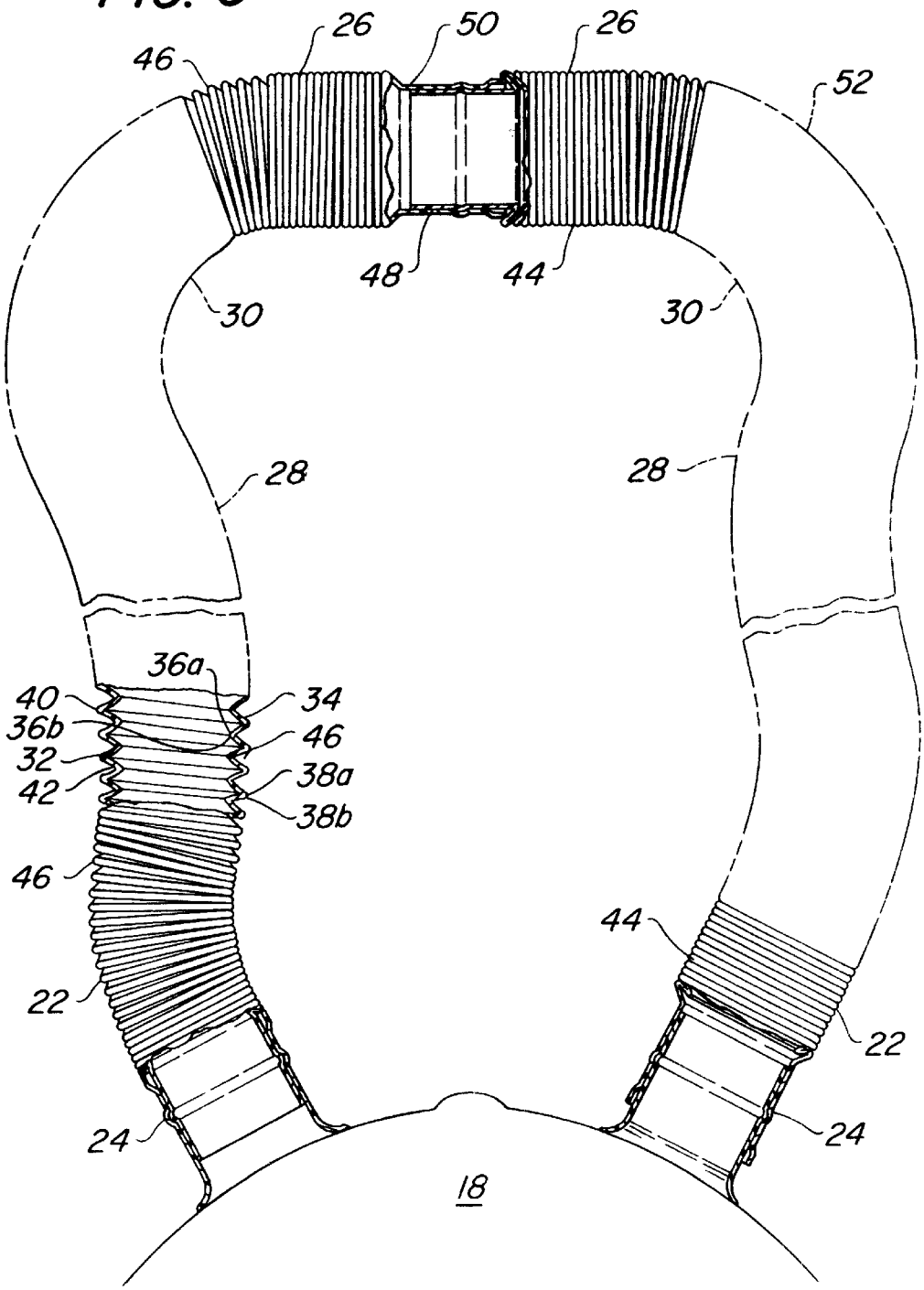
FIG. 3 is a partial elevational view showing various details of the projections extending from the helmet shown in FIG. 1.

Each flexible, compliant portion 28 preferably extends substantially over the entire length of a respective projection 22, providing the ability to bend, curve, curl, expand, contract or otherwise distort the shape of each projection over its entire length. As best illustrated in FIG. 3, the flexible, compliant portion 28 is formed from a resilient, flexible plastic material, such as polypropylene, molded into a tube 30 having a sidewall 32 comprising a plurality of annuli 34 arranged coaxially face to face adjacent one another. Each annulus 34 has an inner circumference 36*a* attached to an inner circumference 36*b* of an adjacent annulus and an outer circumference 38*a* attached to an outer circumference 38*b* of another adjacent annulus so as to form, lengthwise along the tube, a series of peaks 40 and valleys 42 defined by the outer circumferences 38*a* and 38*b* and the inner circumferences 36*a* and 36*b* respectively. Each annulus 34 preferably has a frusto-conical shape and a width different from an adjacent annulus such that an annulus having a relatively greater width is positioned adjacent to an annulus having a relatively smaller width. The width is defined as the difference between the outer and inner diameters of an annulus. Each annulus is stabily positionable in a first position in contact with an adjacent annulus as illustrated at 44 and a second position 46 angularly displaced away from an adjacent annulus, the first and second positions allowing the tube to be bent, curved, expanded and compressed in a desired configuration and maintain the configuration due to the stability of the first and the second positions 44 and 46 of the annuli. Such tubes are described in U.S. Pat. No. 5,395,278 which is hereby incorporated by reference.

Other types of projections which are flexible and compliant are also feasible and are considered to be within the scope of the present invention. For example, projections having a wire core of malleable material, such as copper, would also have the characteristics desired for the invention, in that such projections would be manually manipulatable into various desired shapes and remain in those shapes until manually reconfigured. Examples of other types of projections contemplated include multi-branched projections, articulated projection, and compound projections formed of discrete interlinking components.

As shown in FIG. 1, tubes 30 preferably have couplings 48 or 50 at the free ends 26 distal to the surface 18. As shown in FIGS. 2 and 3, the couplings are complementary to one another in the sense that coupling 50 is adapted, by virtue of its size and shape, to be compatible with and receive coupling 48 in engagement to join two tubes 30 together in a substantially continuous loop 52 extending from the the tubes together provides greater variety in the shapes and configurations in which the projections 22 may be arranged in order to create amusing and attention getting designs.

The tubes and the helmet according to the preferred embodiment of the invention may be molded of brightly colored plastics to further enhance the attention getting qualities of the headgear. The colors may also be coordinated in conjunction with the promotional aspects of the headgear to display colors associated with a sports team, a company, an organization or other subject of the promotion.

Headgear according to the invention provides a unique and inherently flamboyant vehicle for amusement and promotion.

What is claimed is:

1. Headgear for wearing on a head, said headgear comprising a structure adapted for support upon said head, and an elongated projection having a first end attached to said structure and a free end extending outwardly away therefrom, said projection having a flexible, compliant portion arranged between said ends allowing said projection to be manually manipulatable into a desired shape, said flexible, compliant portion maintaining said desired shape until manually manipulated into another desired shape.

2. Headgear according to claim 1, wherein said flexible, compliant portion extends substantially over the entire length of said projection.

3. Headgear according to claim 2, wherein said structure comprises a hat having a crown and a brim, said first end of said projection being attached to one of said crown and said brim.

4. Headgear according to claim 3, wherein said hat comprises a helmet having a rigid shell forming said crown and said brim.

5. Headgear according to claim 4, further comprising a plurality of said projections, each said projection having a first end attached to one of said crown and said brim.

6. Headgear according to claim 5, wherein said free end of one of said projections has a coupling mounted thereon, and said free end of another of said projections has a complementary coupling mounted thereon, said complementary coupling being adapted to engage said coupling on said one projection and thereby form a substantially continuous loop projecting outwardly from said helmet.

7. Headgear according to claim 6, wherein said flexible, compliant portion of each said projection comprises a tube having a sidewall comprising a plurality of annuli arranged coaxially face-to-face adjacent one another, each said annulus having an inner circumference attached to an inner circumference of an adjacent annulus and an outer circumference attached to an outer circumference of another adjacent annulus so as to form, lengthwise along said tube, a series of peaks and valleys defined by said outer circumferences and said inner circumferences respectively.

8. Headgear according to claim 7, wherein each said annulus has a frusto-conical shape.

9. Headgear according to claim 8, wherein each said annulus has a width different from an adjacent annulus such that an annulus having a relatively greater width is positioned adjacent to an annulus having a relatively smaller width, said width being defined as the difference between the outer and inner diameters of an annulus, each said annulus being stabily positionable in a first position in contact with an adjacent annulus and a second position angularly displaced away from an adjacent annulus, said first and second positions allowing said tube to be bent, curved, expanded and compressed in a desired configuration and maintain said configuration due to the stability of said first and said second positions of said annuli.

10. Headgear according to claim 7, wherein said tubes comprise a thermoplastic material.

11. Headgear according to claim 3, further comprising a plurality of said projections, each said projection having a first end attached to one of said crown and said brim.

12. Headgear according to claim 11, wherein said free end of one of said projections has a coupling mounted thereon, and said free end of another of said projections has a complementary coupling mounted thereon, said complementary coupling being adapted to engage said coupling on said one projection and thereby form a substantially continuous loop projecting outwardly from said structure.

13. Headgear according to claim 12, wherein said flexible, compliant portion of each said projection comprises a tube having a sidewall comprising a plurality of annuli arranged coaxially face-to-face adjacent one another, each said annulus having an inner circumference attached to an inner circumference of an adjacent annulus and an outer circumference attached to an outer circumference of another adjacent annulus so as to form, lengthwise along said tube, a series of peaks and valleys defined by said outer circumferences and said inner circumferences respectively.

14. Headgear according to claim 13, wherein each said annulus has a frusto-conical shape.

15. Headgear according to claim 14, wherein each said annulus has a width different from an adjacent annulus such that an annulus having a relatively greater width is positioned adjacent to an annulus having a relatively smaller width, said width being defined as the difference between the outer and inner diameters of an annulus, each said annulus being stabily positionable in a first position in contact with an adjacent annulus and a second position angularly displaced away from an adjacent annulus, said first and second positions allowing said tube to be bent, curved, expanded and compressed in a desired configuration and maintain said configuration due to the stability of said first and said second positions of said annuli.

16. Headgear according to claim 13, wherein said tubes comprise a thermoplastic material.

17. Headgear for wearing on a head, said headgear comprising a means for supporting said headgear upon said head, and an elongated projection means having a first end attached to said supporting means and a free end extending outwardly away therefrom, said projection means having a manually manipulatable means arranged between said ends for manually manipulating said elongated projection means into a desired shape, said manually manipulatable means maintaining said desired shape until manually manipulated into another desired shape.

18. Headgear according to claim 17, further comprising a plurality of said projection means, each being attached to said supporting means.

19. Headgear according to claim 18, wherein said free end of one of said projection means has a coupling means mounted thereon, and said free end of another of said projection means has a complementary coupling means mounted thereon, said complementary coupling means being adapted to engage said coupling means on said one projection means and thereby form a substantially continuous loop projecting outwardly from said supporting means.

20. Headgear according to claim 17, wherein said manually manipulatable means of each said projection means comprises a tube having a sidewall comprising a plurality of annuli arranged coaxially face-to-face adjacent one another, each said annulus having an inner circumference attached to an inner circumference of an adjacent annulus and an outer circumference attached to an outer circumference of another adjacent annulus so as to form, lengthwise along said tube, a series of peaks and valleys defined by said outer circumferences and said inner circumferences respectively.

* * * * *